US005253588A

United States Patent [19]

Vogt et al.

[11] Patent Number: 5,253,588

[45] Date of Patent: Oct. 19, 1993

[54] DEVICE FOR REDUCING THE SPIN RATE OF A SUBMUNITION UNIT

[75] Inventors: Karl-Heinz Vogt, Essen; Heinz Olmscheid, Castrop-Rauxel, both of Fed. Rep. of Germany

[73] Assignee: Rheinmetall GmbH, Ratingen, Fed. Rep. of Germany

[21] Appl. No.: 900,132

[22] Filed: Jun. 18, 1992

[30] Foreign Application Priority Data

Jul. 25, 1991 [DE] Fed. Rep. of Germany ..... 4124658

[51] Int. Cl.[5] ..... F42B 10/14

[52] U.S. Cl. ..... 102/386; 102/388; 102/489; 244/3.3

[58] Field of Search ..... 102/386, 388, 393, 489, 102/400, 339, 348; 244/3.1, 3.27, 3.28, 3.29, 3.3

[56] References Cited

U.S. PATENT DOCUMENTS

| | | | |
|---|---|---|---|
| H776 | 5/1990 | Cole | 102/388 |
| 1,309,530 | 7/1919 | Lamberson | 102/504 |
| 2,565,470 | 8/1951 | Brown | 102/387 |
| 3,047,259 | 7/1962 | Tatnall et al. | 102/386 |
| 3,273,834 | 9/1966 | Bower | 102/388 |
| 3,439,610 | 4/1969 | Myers | 102/388 |
| 4,752,052 | 6/1988 | Galvin | 244/3.29 |
| 4,856,432 | 8/1989 | Synofzik | 102/489 |
| 4,856,737 | 8/1989 | Zacharin | 244/113 |
| 4,860,660 | 8/1989 | Synofzik et al. | 102/386 |
| 4,958,566 | 9/1990 | Siebrand et al. | 102/386 |
| 4,986,185 | 1/1991 | Kuhnle et al. | 102/388 |
| 5,016,533 | 5/1991 | Börgen | 102/386 |
| 5,054,400 | 10/1991 | Pineau et al. | 102/489 |
| 5,067,410 | 11/1991 | Murnane et al. | 102/489 |

FOREIGN PATENT DOCUMENTS

| | | |
|---|---|---|
| 0274579 | 7/1988 | European Pat. Off. . |
| 0275370 | 7/1988 | European Pat. Off. . |
| 3643294 | 6/1988 | Fed. Rep. of Germany . |

*Primary Examiner*—David H. Brown

*Attorney, Agent, or Firm*—Spencer, Frank & Schneider

[57] ABSTRACT

A device is provided for reducing the rate of rotation of a spinning submunition unit having a tail end provided with a deployable braking device, from a time after the submunition unit is ejected from a spin stabilized carrier projectile until the braking device is deployed. The device includes a plurality of bands arranged to form a star-shaped symmetrical band structure for placement around the braking device. Each of the bands has a free end provided with a wind pocket.

4 Claims, 1 Drawing Sheet

DEVICE FOR REDUCING THE SPIN RATE OF A SUBMUNITION UNIT

BACKGROUND OF THE INVENTION

The present invention relates to a device for reducing the rate of rotation of a spinning submunition unit having a tail end provided with a deployable braking device, from a time after the submunition unit is ejected from a spin stabilized carrier projectile until the braking device is deployed.

In order to lower the spin rate of a submunition unit after ejection from a spin stabilized carrier projectile until a braking device opens that also has a spin reducing effect, it is known to employ short spin braking fins made of metal or cloth so as to reduce the spin down to a value that is non-critical for the strength of the braking device. However, such spin braking fins require additional machining and working of the submunition unit. Additionally, the fins become effective immediately upon ejection and they remain attached to the submunition unit.

It is further known to employ textile discs for this purpose, as disclosed for example in European Patent Application EP-A 0,275,370. Such discs reduce the traveling velocity of the submunition in an undesirable manner and thus delay the function sequence.

SUMMARY OF THE INVENTION

It is an object of the present invention to provide a device of the type first described above which does not significantly adversely influence the traveling velocity of the submunition and involves less manufacturing costs and no working of the submunition unit.

The above and other objects are accomplished in accordance with the invention by the provision of a device for reducing the rate of rotation of a spinning submunition unit having a tail end provided with a deployable braking device, from a time after the submunition unit is ejected from a spin stabilized carrier projectile until the braking device is deployed, comprising: a plurality of bands arranged to form a star-shaped symmetrical band structure for placement around the braking device, each of the bands having a free end; and a wind pocket attached to each of the free ends.

The invention will now be described in greater detail with reference to an embodiment that is depicted in the attached schematic drawings.

DETAILED DESCRIPTION OF PREFERRED EMBODIMENTS

Figure 1:
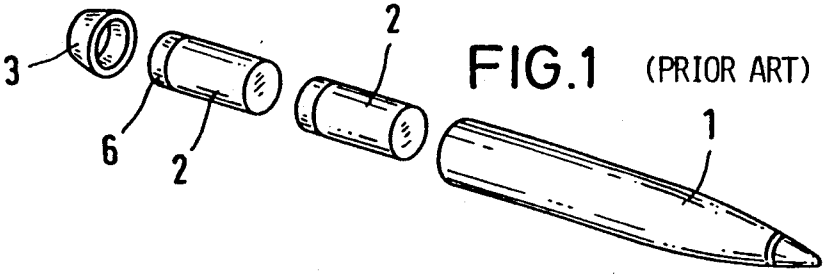
FIG.1 (PRIOR ART)
FIG. 1 depicts a carrier projectile with an ejected submunition unit as already known in the prior art.

Referring to FIG. 1, there is shown a spin stabilized carrier projectile 1 a predetermined time after the firing of an ejection charge (not shown) whereby a projectile bottom 3 is severed from the projectile carrier and submunition units 2 are released from the projectile. Submunition units 2 initially move at essentially the same traveling velocity and with the same spin as carrier projectile 1. A spin stabilized carrier projectile carrying ejectable submunition units is disclosed, for example, in U.S. Pat. No. 4,856,432.

To reduce velocity and spin, submunition unit 2 is provided at its tail with a braking device 5 which may be accommodated in a package 4 that may be, in particular, a ballute [balloon + parachute] equipped with wind catching pockets. Such a braking device and associated package are disclosed in German Patent Application P 41 20 339.9 and its corresponding U.S. patent application 898,531, filed on Jun. 15, 1992. Braking device 5, together with its package 4, is packed by way of a star-shaped band structure 7 in the stowage area of a cover 6 or the like that is released together with submunition unit 2 due to the influence of spin.

Figure 3:
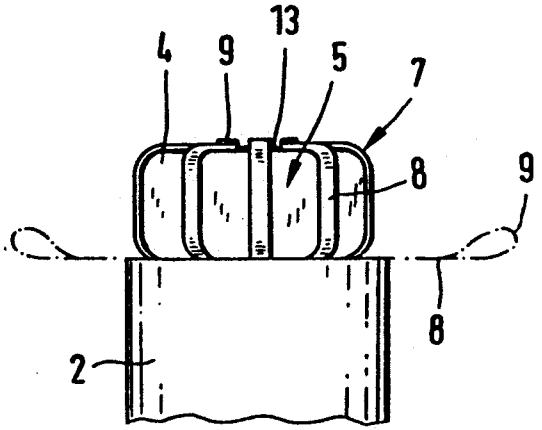
FIG. 3 is a partial sectional side view of a submunition unit with a device for reducing the spin rate in accordance with the invention, shown by solid lines in an inactivated state, and by dot-dash lines in an activated state.
Figure 4:
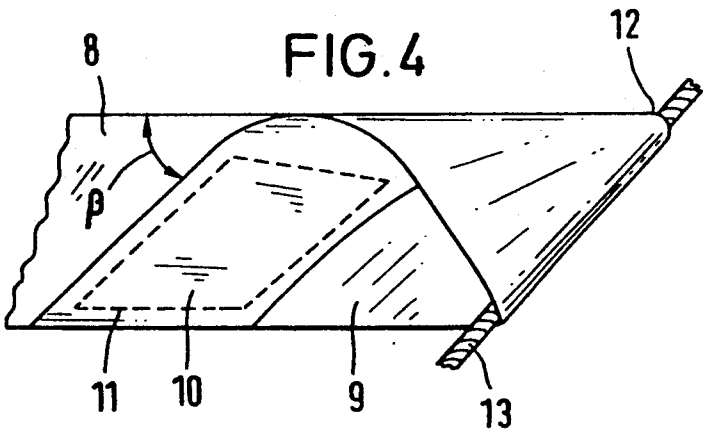
FIG. 4 is an enlarged perspective view of the pocket portion of a device for reducing the spin rate of a submunition unit in accordance with the invention.
Figure 2:
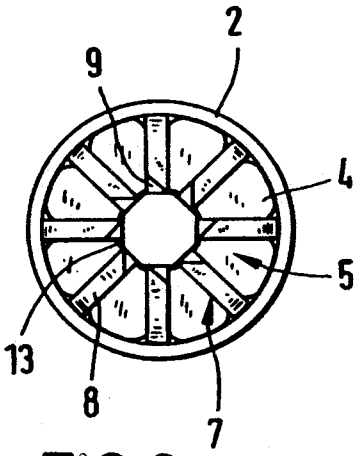
FIG. 2 is a top view of a device in an inactivated state for reducing the spin rate of a submunition unit in accordance with the invention.

Star-shaped symmetrical band structure 7 is made of a plurality of individual bands 8 of a firm textile or plastic material. As shown in FIG. 3, band structure 7 is disposed between braking device 5 and submunition unit 2 and the free ends of individual bands 8 are wrapped around and enclose braking device 5. Band structure 7 may be fastened, for example, to the device for fastening braking device 5 to submunition unit 2 or may be clamped in between braking device 5 and submunition unit 2. For this purpose, the individual bands 8 may be connected with a central ring (not shown).

The free ends of bands 8 are provided with wind pockets 9 which are preferably formed by twisting an end section 10 of the band and turning the twisted end portion over in a direction toward the center of the band structure so that end section 10 comes to lie on band 8 and is connected with band 8 by way of a seam 11. By appropriate sewing of end section 10, an angle $\beta$ can be set in a desired manner. Desirably, a flow opening 12 may be left at the tip of each wind pocket 9.

Flow opening 12 may simultaneously be employed to receive a break line 13 of desired weakness with which bands 8, placed around braking device 5, are held together in a non-activated state. Alternatively, eye loops (not shown) may be attached to the ends of the band for this purpose.

After exposure of the stowage area for braking device 5, break line 13 ruptures as a result of the centrifugal forces acting on it due to the spinning of submunition unit 2. Because of the centrifugal forces, the individual bands 8 are placed radially outwardly, as shown by the dash-dot lines in FIG. 3, and their wind pockets 9 generate a torque which reduces the rate of rotation of the submunition unit, while braking device 5 itself is still being held together by its packaging. The reduction of the spin rate is effective without any significant additional reduction of the traveling velocity of the submunition unit. Due to the relatively low radial expansion required for band structure 7, any later influences on the braking device once it has been activated are avoided. Advantageously, the band structure 7 is activated to reduce spin of submunition unit 2 not when it leaves carrier projectile 1, but after the stowage area is released for braking device 5 by axial separation of the projectile components. Before braking device 5 is activated, band structure 7 reduces the spin to values that are unobjectionable for the strength of braking device 5.

Obviously, numerous and additional modifications and variations of the present invention are possible in light of the above teachings. It is therefore to be understood that within the scope of the appended claims, the invention may be practiced otherwise than as specifically claimed.

What is claimed is:

1. A device for reducing the rate of rotation of a spinning submunition unit having a tail end provided with a deployable braking device, from a time after the submunition unit is ejected from a spin stabilized carrier projectile until the braking device is deployed, comprising:

a plurality of bands arranged to form a star-shaped symmetrical band structure for placement around the braking device, each of said bands having a free end;

a wind pocket attached to each of said free ends; and a break line for holding together the free ends of said bands.

2. A device as defined in claim 1, wherein each said wind pocket has a tip provided with a flow opening.

3. A device for reducing the rate of rotation of a spinning submunition unit having a tail end provided with a deployable braking device, from a time after the submunition unit is ejected from a spin stabilized carrier projectile until the braking device is deployed, comprising:

a plurality of bands arranged to form a star-shaped symmetrical band structure for placement around the braking device, each of said bands having a free end; and a wind pocket attached to each of said free ends, wherein said wind pockets each comprise an end section of a respective one of said bands which is twisted, turned over and sewn onto itself.

4. A device as defined in claim 3, wherein said wind pockets each has a tip provided with a flow opening.

* * * * *